United States Patent [19]

Spann

[11] 4,233,700

[45] Nov. 18, 1980

[54] VENTILATED BODY POSITIONER

[76] Inventor: Donald C. Spann, 5 Ferncreek Ct., Greenville, S.C. 29615

[21] Appl. No.: 44,261

[22] Filed: May 31, 1979

[51] Int. Cl.[3] ..... A47C 21/00; A47C 27/14

[52] U.S. Cl. ..... 5/431; 5/468; 5/481; 5/437

[58] Field of Search ..... 5/428, 431–437, 5/440, 465, 467–469, 481; 297/453; 128/33, 42

[56] References Cited

U.S. PATENT DOCUMENTS

| | | | |
|---|---|---|---|
| 2,933,738 | 4/1960 | Whelan . | |
| 3,124,812 | 3/1964 | Milton et al. | 5/435 |
| 3,331,089 | 7/1967 | Ornas, Jr. et al. | 5/468 |
| 3,512,189 | 5/1970 | Swanson | 5/431 |
| 3,601,121 | 8/1971 | Roberts | 5/436 |
| 3,626,526 | 12/1971 | Roberts | 4/35 |
| 3,694,831 | 9/1972 | Trease | 5/465 |
| 3,938,205 | 2/1976 | Spann | 5/431 |
| 3,987,507 | 10/1976 | Hall . | |
| 4,028,754 | 6/1977 | Eary, Sr. . | |

*Primary Examiner*—Casmir A. Nunberg
*Attorney, Agent, or Firm*—Bailey, Dority & Flint

[57] ABSTRACT

A ventilated body positioner device and the like is formed from a block of polyurethane foam having resilient characteristics capable of deformation of the type having a length substantially greater than its width so that the block may be rotated on one of a plurality of major surfaces to provide an adjustable positioning support surface for a major portion of a patient's body while lying upon a table or bed surface wherein various cut-outs and air circulation channels enhance the ventilation capabilities of the device while positioning a patient.

5 Claims, 7 Drawing Figures

VENTILATED BODY POSITIONER

BACKGROUND OF THE INVENTION

In many instances, it is necessary to position a patient lying laterally upon a bed or table surface in an angular position relative to the table instead of a strictly supine position.

Heretofore, an arrangement including an unsymmetrical elongated foam positioner block has been proposed in applicant's U.S. Pat. No. 3,938,205. However, it has been found that during periods of prolonged patient immobility that the body weight pressures exerted on the supported portion of the body together with the resultant heat and moisture generated often results in the formation of a decubitus ulcer, particularly in the patient's sacral area.

Accordingly, it is an important object of the present invention to provide a versatile body positioner block for positioning the body of a patient while lying laterally on a bed or table having increased ventilation capabilities.

Another important object of the invention is to provide a ventilated body positioner block which will adequately ventilate and reduce pressure on the sacral area of a patient supported in a side rotated position and reduce the occurrence of decubitus ulcers.

Yet another important object of the present invention is the provision of a ventilated body positioner having ventilation channels through which a natural or forced current of air may be delivered for airing out highly moist areas.

SUMMARY OF THE INVENTION

It has been found that a ventilated body positioner for a patient lying on a bed and the like may be formed from an elongated resilient foam block having a plurality of major support surfaces affording versatility in positioning a patient wherein cut-outs and interior ventilation channels are formed to enhance ventilation and reduced pressure in strategic areas of a patient so positioned.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 2:
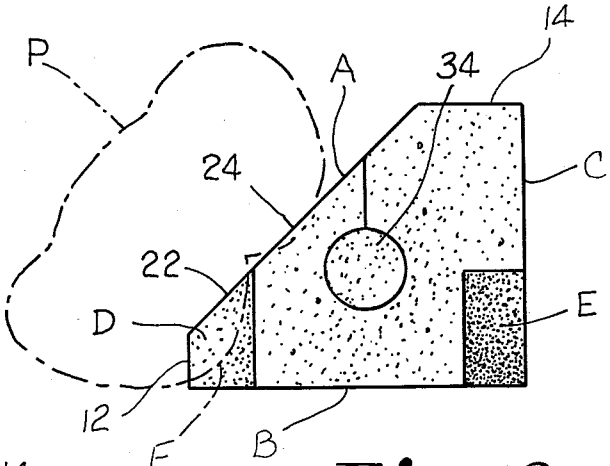
FIG. 2 is an end view illustrating a patient supported on one of the supporting surfaces of a body positioner block according to the invention.
Figure 7:
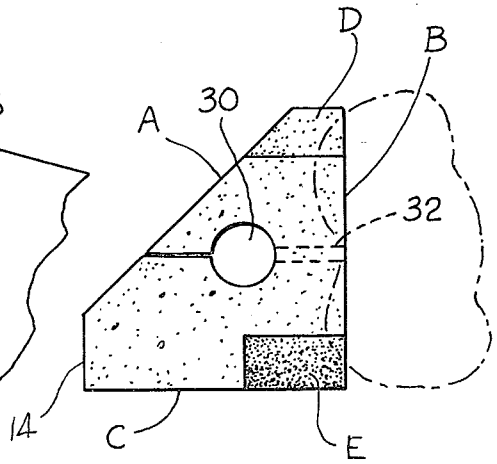
FIG. 7 is an end view illustrating a patient supported on another supporting surface when the body positioner is oriented as shown in FIG. 5.
Figure 1:
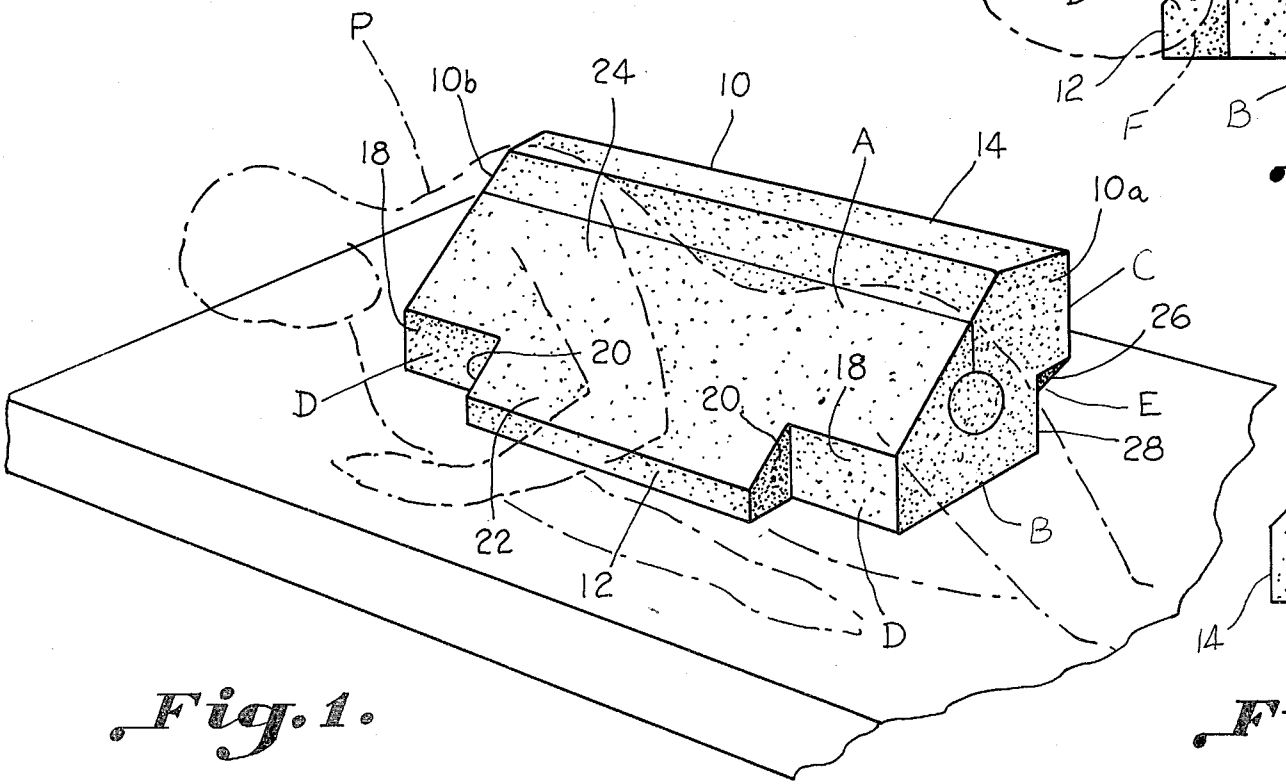
FIG. 1 is a perspective view illustrating a ventilated body positioner constructed according to the invention with a patient positioned and supported thereon.
Figure 3:
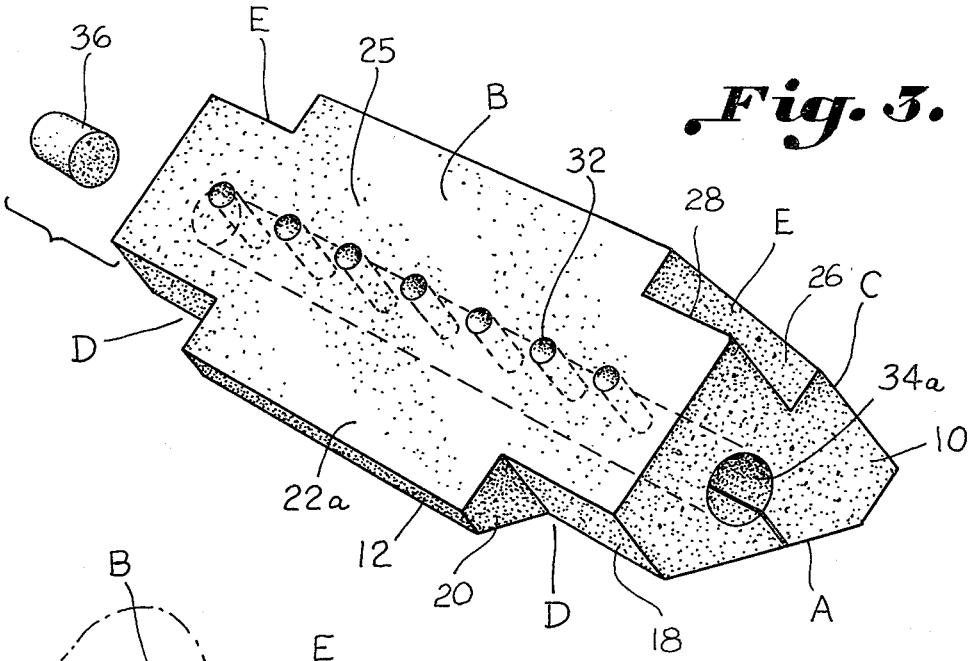
FIG. 3 is a perspective view of a ventilated body positioner block constructed according to the invention illustrating another supporting surface thereof being ventilated according to the invention.
Figure 4:
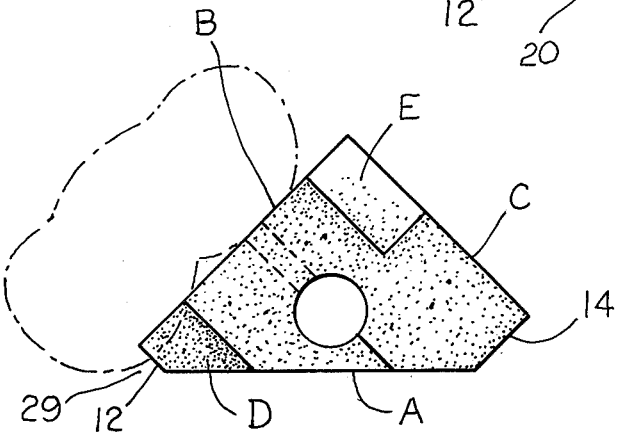
FIG. 4 is an end view illustrating a patient's body supported on the body positioner block as oriented in FIG. 3.
Figure 6:
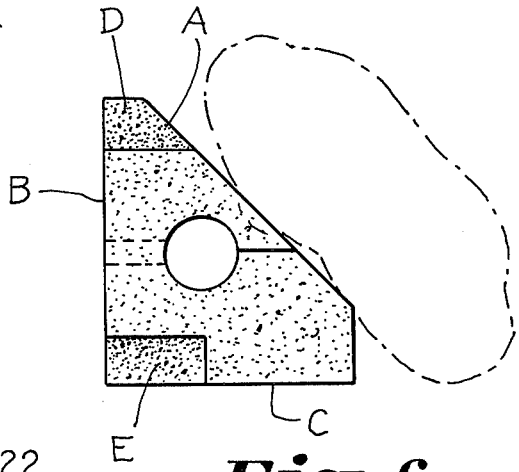
FIG. 6 is an end view illustrating a patient supported on a supporting surface thereof when oriented in the manner shown in FIG. 5.
Figure 5:
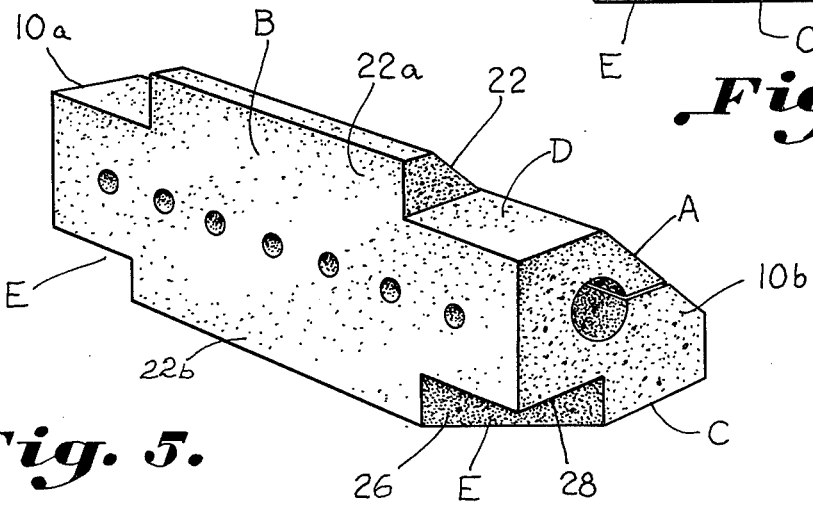
FIG. 5 is a perspective view of a ventilated body positioner constructed according to the invention illustrating another supporting surface and orientation of the positioning block.

The drawing illustrates a ventilated body positioner which provides lateral support for the body of a patient lying in a side position while providing ventilation and reduced pressure at strategic areas of support. The ventilated body positioner includes an elongated positioner block of resilient deformable material such as a high density polyurethane foam having spaced longitudinal ends and a plurality of ventilated major planar surfaces A, B, and C on which the block may be rotated and selectively placed as either a base or a ventilated body supporting surface extending generally between the ends of the block. The planar surfaces A, B, and C are relatively inclined to one another such that the positioner block placed on one of the planar surfaces presents another of the planar surfaces as a longitudinal body support surface having a widened sloping contour for properly positioning the patient in a side rotated position.

The body positioner block and hence each of the planar surfaces has a length substantially greater than its lateral width for supporting a substantial portion of the patient's lateral body length. A cavity D adjacent end portions of the elongated positioner block is formed by cutting out portions of the block in a plane transverse to the plane of the planar surfaces. The cavity terminates to define a longitudinally extending edge support surface extending laterally from a main supporting surface which contact and support an area of the patient's body while the cavity provides ventilation to a non-contracted but supported area of the patient's body adjacent the contacted area reducing the buildup of heat and moisture and pressure at the areas to increase confort and reduce the formation of decubitus ulcers.

Referring now in more detail to the drawing, a ventilated body positioner block 10 is illustrated for variably adjusting the position of and supporting a patient lying laterally upon a bed surface, and operating or examining table surface. The body positioner block includes an elongated block 10 constructed of a suitable resilient deformable material such as a high density polyurethane foam. The block is advantageously constructed as a triangular block which is shaped by cutting or sawing off the triangular edge portions of different widths from the forty-five degree edges. The resulting elongated block is preferably unsymmetrical in cross-section having major planar surfaces A, B, and C and minor surfaces 12 and 14. The minor surfaces 12 and 14 give a finished appearance to the otherwise feathered edges.

In use, the body positioner block can be based on any one of three major ventilated surfaces, such as C as illustrated in FIG. 2, and the patient's body may be adjustably positioned on one of the remaining major surfaces A or B. With the patient's body supported on surface A, the corresponding minor surfaces 12 and 14 afford some degree of ventilation by providing a void space between the bed or table surface and the patient's body in which air may circulate. Such a support affords a sufficiently stable support for a patient in a side rotated position lying laterally on a flat surface.

FIGS. 2, 4, 6, and 7 illustrate the positioning of the body of a patient P in various configurations and with the body positioner block 10 placed on each of the major planar surfaces A, B and C whereby the patient's body may be supported on any one of the remaining major surfaces. The illustrations show the body positioner block without deformation. In the end views, an attempt has been made to show, schematically, the patient's body in dotted lines to the extent that the foam block may be deformed when supporting the patient's weight for the purpose of illustration only.

As illustrated, cavities D and E are provided at end portions 10*a* and 10*b* of the elongated positioner block 10 which are formed by cutting out portions of the corners of the block at the respective planar surfaces by any suitable cutting process. Cavity D is formed by cutting out the corners of the block 10 in a plane transverse to the surfaces A and B. A first cut is made longitudinally in the block and at right angles to end portion 10*a* thereof to define a first surface 18 perpendicular to the planar surface C and a second transverse cut which defines a surface 20 perpendicular to the planar surface C and surface 18. An identical cut is formed at the opposing corner at the end portion 10*b*. In this manner, ventilation and reduced pressure may be had at the sacral area when the patient is positioned on either the left or right side. Cavities so formed terminate longitudinally to define a longitudinally extending edge support surface 22 which extends laterally from a main support surface 24 of the planar surface A and an edge support surface 22*a* laterally extended from a main support surface 25 of surface B. A similar edge support surface is provided at 22*b*.

The cavity E, as best seen in FIGS. 3–7, is formed by first making a straight vertical cut diagonally across a corner of planar surface C which forms a planar surface 26. A second cut transverse to the surface B and end portion 10*b* and perpendicular to the surface 26 forms a planar surface 28. It is noted that the cut which provides the planar surface 26 is diagonally aross the corner of the planar surface C at opposing ends thereof which may be advantageously made by one vertical cutting. The result is that surface 28 has a triangular shape. An identical cavity is formed at the opposing corner at end portion 10*a*.

In normal use, the body positioner block is utiliized to support a substantial portion of the patient's lateral body length from approximately the shoulders to slightly below the waist. It has been found that the cavity means D and E greatly enhance and facilitate air ventilation and reduced pressure on the sacral area of the patient's back when supported on a respective major surface greatly reducing the likelihood that a decubitus ulcer will form at this strategic areasuch as at F in FIG. 2. This problem arises in that when a patient is initially positioned on the block, there is a tendency for the body to slide down the support surface and bunch up and pinch foam material and bed sheeting together between the body. When the sheeting and foam material gather up against the patient's body, considerable heat, moisture and pressure is built up which creates discomfort and increases the chances for the formation of decubitus ulcers in the sacral area, which is a considerable problem. The cavity means D and E get air to the sacral area of the patient's body which is supported in this area without contacting the positioner block whereas the contacting portions of the body surrounding the cavity afford adequate support with reduced pressure. The cavities D and E also act as funnels to increase the circulation of air through the void spaces created by surfaces 12 and 14 such as illustrated at 29.

Longitudinal channel means 30 is formed in the interior of the positioner block 10 extending along the entire length thereof and bore opening means 32 communicate with the channel means 30 and open at the surface B of the positioner block to provide a means whereby air may be circulated to the patient's body supported thereon. It is noted that the channel means is open at both ends so that circulation of air is considerably enhanced. A solid plug 34 may be provided which fills channel 30 when in place so that when this increased ventilation is not needed, a solid support may be had. However, adequate support is provided with the plug removed. To utilize the channel means 30 as a means to supply a forced conveyance of air to the patient's body supported on surface B, a solid shortened plug 36 may be sawed off or provided for filling one end of the channel means only. In this case, the opposing open end 30*a* may be adapted such as by placement of a flexible hose therein for connection to a blower of some type to deliver a forced conveyance of air through the channel outwardly through openings 32 to the area of the patient's body supported on planar surface B. In this manner, the positioner block may be utilized to dry out a portion of the patient's back where wetness or increased moisture has occurred.

Thus, it can be seen that an advantageous construction can be had for a ventilated body positioner according to the invention wherein various cavities are cut out in the corners of the block to afford ventilation and reduction of pressure at strategic areas of a patient's body supported thereon, particularly advantageous in decreasing the likelihood of the formation of decubitus ulcers in the sacral area and the buildup of heat and moisture which adds to the patient's discomfort and wherein free or forced circulation of air may be had through the block as the need arises.

While a preferred embodiment of the invention has been described using specific terms, such description is for illustrative purposes only, and it is to be understood that changes and variations may be made without departing from the spirit or scope of the following claims.

What is claimed is:

1. A ventilated body positioner for providing lateral support for the body of a patient lying in a side position while providing ventilation and reduced pressure at strategic areas of support, said ventilated body positioner comprising:

an elongated positioner block of resilient deformable material having spaced longitudinal end portions and a plurality of planar surfaces on which said block may be rotated and selectively positioned as either a base or body supporting surface extending generally between said ends;

said planar surfaces being relatively inclined such that said elongated positioner block based on one of said planar surfaces presents another of said planar surfaces as a longitudinal body support surface having a widened sloping contour for properly positioning the patient in a side-rotated position;

said positioner block and hence each said planar surface having a length substantially greater than its lateral width for supporting a substantial portion of the patient's lateral body length;

a cavity adjacent end portions of said elongated positioner block formed by cutting out a portion of said block in a plane transverse to the plane of said planar surfaces; and said cavity terminating to define a longitudinally extending edge support surface extending laterally from a main support surface which contact and support an area of said patient's body while said cavity provides ventilation to a non-contacted, supported area of said patient's body adjacent said contacted area reducing the buildup of heat and moisture and pressure at said areas to prevent the formation of decubitus ulcers.

2. The structure set forth in claim 1 including longitudinal channel means formed in the interior of said elongated positioner block and bore means communicating with said channel means extending outwardly to one of said planar surfaces so that air is circulated to the supported area of the patient's body.

3. The structure set forth in claim 2 wherein said channel means is open at opposing ends of said positioner block facilitating the circulation of air therethrough.

4. The structure set forth in claim 3 including a plug receivable in said channel means to close an end thereof with said other end being open and adaptable for receiving a conveyance of air through said channel means and hence outwardly through said bore means to support surface.

5. The structure set forth in claim 1 wherein said cavity is formed at opposing corners of said ends facilitating ventilation and reduced pressure in the sacral area of the supported body portion.

* * * * *